United States Patent [19]

Walldorf

[11] Patent Number: 4,586,622

[45] Date of Patent: May 6, 1986

[54] TAMPER-RESISTANT PHARMACEUTICAL VIAL AND CAP ASSEMBLY

[75] Inventor: Diann Walldorf, Palatine, Ill.

[73] Assignee: Affiliated Hospital Products, Inc., St. Louis, Mo.

[21] Appl. No.: 631,380

[22] Filed: Jul. 16, 1984

[51] Int. Cl.[4] ..... B65D 41/48

[52] U.S. Cl. ..... 215/256; 220/270; 220/254

[58] Field of Search ..... 215/256; 220/270, 276, 220/254

[56] References Cited

U.S. PATENT DOCUMENTS

| | | | |
|---|---|---|---|
| 3,142,402 | 7/1964 | Fox | 215/256 |
| 3,979,002 | 9/1976 | Faulstich | 215/256 |
| 4,066,181 | 1/1978 | Robinson et al. | 215/256 |
| 4,281,774 | 8/1981 | Mumford | 215/256 X |
| 4,420,092 | 12/1983 | Finkelstein | 215/256 X |
| 4,437,574 | 3/1984 | Ruklic | 215/256 |

FOREIGN PATENT DOCUMENTS

| | | | |
|---|---|---|---|
| 2422861 | 12/1974 | Fed. Rep. of Germany | 220/276 |

*Primary Examiner*—Donald F. Norton

*Attorney, Agent, or Firm*—McDermott, Will & Emery

[57] ABSTRACT

A cap or closure for a pharmaceutical vial includes a fill hole to permit filling of the vial with the cap in place. In one form the vial and cap assembly comprises an open-top vial covered by a cap having a depending peripheral skirt. The inner surface of the cap skirt and the outer surface of the vial are provided with complementary mating interlock elements that preclude manual removal of the cap. The cap includes an integral tear member, defined by one or more weakened, partially circumferential weakened junction lines, such that pulling away the tear member along the junction line allows both manual removal of the cap and ready visual confirmation that vial integrity has been breached. The cap includes a fill hole permitting the filling of the vial with the cap in place. The fill hole is closed, after filling, by a resilient stopper having a configuration effectively precluding its manual removal, so that post-filling tampering and contamination are precluded. The stopper is preferably molded together with the cap and may be connected to the cap by an integral strap.

8 Claims, 8 Drawing Figures

TAMPER-RESISTANT PHARMACEUTICAL VIAL AND CAP ASSEMBLY

BACKGROUND

1. Field of the Invention

The present invention relates generally to pharmaceutical vial and cap assemblies. More particularly, the present invention relates to a tamper-resistant assembly which clearly indicates accidental or intentional tampering or contamination.

2. Brief Description of the Prior Art

In retail outlets, hospitals, clinics, and other health care facilities, a wide variety of medications and other pharmaceuticals are delivered or administered to patients for oral ingestion. Oral administration generally requires that a pharmaceutical dose be deposited in a vial in the pharmacy or health care facility, from which it is transported to the patient and ultimately administered. This procedure provides many opportunities for contamination, spillage, or outright tampering, since efficient operation of the drug store, manufacturer or pharmacy makes it desirable to pre-fill a number of vials of a given medication at one time, even though the products are displayed on a shelf for sale or the hospital use may be spread out over several days. If the vials are sealed at the time of filling, the customer, patient or nurse may experience difficulty in opening a vial at the time of administration, depending upon the type and construction of seal employed. Contamination before, during and after filling is a persistent problem. Post-filling tampering or contamination, which may involve removal of part of the contents of a vial, contamination through addition to the contents of the vial, or even complete substitution, is possible.

A number of different constructions are known for sealed vials. Some of these devices employ caps or closures of multipart construction, involving a molded stopper of elastomer or resin material in conjunction with a clamping ring to hold the stopper in place. Additional elements, such as resin or metal covering discs, are commonly used in conjunction with the principal stopper and clamp ring. Access to the vial interior is frequently provided by a slit valve or other opening in the stopper. Devices of this kind are disclosed in Campbell U.S. Pat. No. 2,236,491, Breakstone U.S. Pat. No. 2,579,724, Roberts U.S. Pat. No. 2,797,837, Gould U.S. Pat. No. 3,013,687, Reimann U.S. Pat. No. 3,067,898, Hershberg et al U.S. Pat. No. 3,424,329, Wimmer U.S. Pat. No. 3,653,528, Westfall U.S. Pat. No. 3,690,499, Zackheim U.S. Pat. No. 3,823,840, and in Cantrill British Pat. No. 602,763.

A unit dose vial used for oral administration of pharmaceuticals is describd in Handman U.S. Pat. No. 4,244,478, issued Jan. 13, 1981. This patent discloses an elastomer stopper which seals the vial and affords a rim covering the lip of the vial, together with a metal sealing ring crimped onto the vial and covering the stopper rim. The stopper has a self-venting self-sealing linear slit valve that allows filling of the vial with the stopper in place. The seaing ring includes an integral release tab permitting quick and convenient removal of both the ring and the stopper for oral administration of the vial itself.

Another container and closure assembly adaptable to unit dose vials is described in Miskin U.S. Pat. No. 3,595,420, issued July 27, 1971, in which an open-top vial is covered by a resilient molded cap that has an integral skirt encompassing the upper portion of the vial. The inner surface of the skirt and the outer surface of the vial have complementary mating interlock elements that preclude manual removal of the cap from the vial. The cap comprises a tear member defined by one or more weakened junction lines molded into the skirt. Complete removal of the tear member permits convenient removal of the cap from the vial at the time of administration while, at the same time, may disguise any tampering.

These prior art devices commonly prevent contamination of the interior of the vial prior to and during filling. Frequently, the same devices also prevent casual contamination of the contents of the vial after filling. Indeed, this is true of most of the prior art devices noted above. The Miskin device, on the other hand, provides no protection for the vial before filling, but generally discloses any post-filling tampering with the contents of the vial, whether by way of extraction from or addition to the vial. Another common drawback of these prior art devices is a direct result of their multipart construction. Often the element intended to preclude tampering is completely removed upon administration of the pharmaceutical. Since this protective element is usually missing after the vial has been opened, nurses and, more particularly, patients unfamiliar with the appearance of an intact tamper-resistant device, would have no obvious way of knowing that a vial has been opened.

It was noted that a major reason for the development of these tamper-resistant pharmaceutical vials is that it is more efficient and therefore desirable for a pharmacy to prefill a large number of vials with a given unit dose of medication. This is partially because administrative regimens often continue over several days, and further, because many patients are often on substantially identical regimens. For these reasons it is also desirable to provide a tamper-resistant pharmaceutical vial that can be filled automatically by well known filling machines.

Ideally, a vial intended for oral administration of pharmaceuticals should permit both manual and automatic filling with the vial closure already in place to maintain the vial in clean and sterile condition. At the same time, the vial assembly should permit rapid and convenient removal of the vial cap, by either a nurse or a patient, for oral administration of the pharmaceutical. The vial and closure assembly also should prevent any casual contamination of the contents of the vial after it has been filled and should preclude tampering by addition to, removal from, or even complete substitution for the contents of the vial.

Finally, the vial and closure assembly should clearly communicate the occurrence of any intentional or accidental post-filling tampering or contamination of the contents. These somewhat conflicting requirements have not been fully and effectively met in any single vial and closure assembly of the prior art.

SUMMARY OF THE INVENTION

It is an object of the present invention, therefore, to provide a new and improved cap for use in a vial and cap assembly suitable for use in unit dose oral administration of pharmaceuticals which maintains the vial effectively closed prior to filling, permits rapid filling of the vial with the cap in place, and which effectively precludes both post-filling contamination and tampering.

It is a specific object of the present invention to provide a new and improved cap assembly that will provide an obvious notice of the occurrence of any post-filling contamination or tampering.

Another object of the invention is to provide a new and improved tamper-evident pharmaceutical vial and cap assembly that can be filled with the cap on the vial and that is simple an inexpensive in construction, with the entire closure for the vial constituting a unitary device of molded resilient material.

It is a further object of the present invention to provide a new and improved cap which clearly discloses any tampering.

DESCRIPTION OF THE PREFERRED EMBODIMENTS

Figure 1:
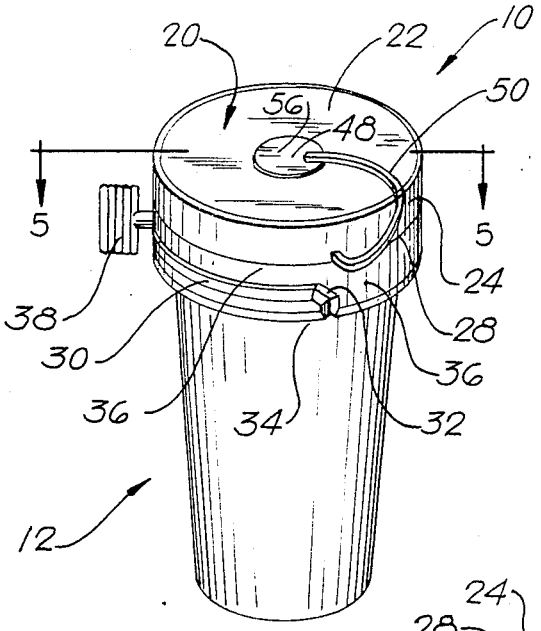
FIG. 1 is a perspective view of a tamper-resistant pharmaceutical cap on a vial construction in accordance with a preferred embodiment of the present invention.

FIGS. 1–5 illustrate a tamper-resistant unit dose pharmaceutical vial and cap assembly, generally designated, 10 for dispensation and oral administration of a predetermined dosage of a pharmaceutical preparation, constructed in accordance with a preferred embodiment of the present invention. The assembly 10 includes an open top vial 12, preferably formed of molded resin. Typically, the vial 12 may be molded of USP amber polypropylene of with an overall height of about 2.5 inches, a diameter of about one inch, and an internal capacity of the order of twenty to thirty milliliters but any size or color can be used. Vial 12 is of simple, open, cup-shaped configuration which includes an external projection or skirt, generally designated 14, extending circumferentially of the outer top portion of the vial as shown in more detail in FIG. 6. The external projection 14 on the vial has an angled upper face portion 16, a vertical side portion 18 and a horizontal, lower face portion 18. Projection 14 may be continuous around the circumference of vial 12, or may comprise a series of spaced projections.

The assembly 10 further comprises a cap 20 of inverted generally cup-shaped configuration including a top 22 and a depending skirt 24 which fits over the top of vial 12. Cap 20 is of molded resilient material; polyethylene is preferred but other resins and elastomers may be employed. The cap may be opaque, in any desired color.

The inner surface of cap skirt 24 includes a V-shaped peripheral indentation 26 (FIG. 5) which extends around the entire inner circumference of the cap skirt 24. When the cap 20 is mounted on vial 12, indentation 26 is generally alignigly engaged by the peripheral external projection 14 on vial 12. A weakened junction line 28 is formed in the external surface of cap skirt 24 opposite the indentation 26 that receives the tip of vial projection 14. Said weakened junction line 28 extends peripherally, circumscribing approximately three-fourths of skirt 24 or approximatey for 270°. A second weakened junction line 30 in skirt 24 is located below line 28. Line 30 does not extend completely around skirt 24 but terminates in an angled line of weakening 32 and a vertical line of weakening 34. The lines 32 and 34 serve to break the lower rim of the skirt 24 as shown in FIG. 1.

The weakened junction lines 28, 30, 32 and 34 define a tear member 36 constituting a tear band extending nearly circumferentially of cap 20. A pull tab 38 is molded integrally with tear member 36 and projects outwardly therefrom to facilitate opening of the assembly 10. A reduced thickness area 40 between the weakened lines 30 and 38 facilitates the opening process. Camming or rotating the tab 38 in the direction as shown by arrow A in FIG. 3 causes the weakened lines 28 and 30 to break at a point behind the tab 38.

Cap 20 is mounted on vial 12 by forcing the cap skirt 24 downwardly over the top of the vial until the projection 14 on the vial engages in the peripheral indentation 26 in the cap skirt. Projection 14 is of sufficient diameter to afford an interference fit with the lower portion of skirt 24 comprising tear strip 36. When mounted in place on vial 12, cap 20 cannot be manually removed from the vial without partial destruction of the cap.

Figure 3:
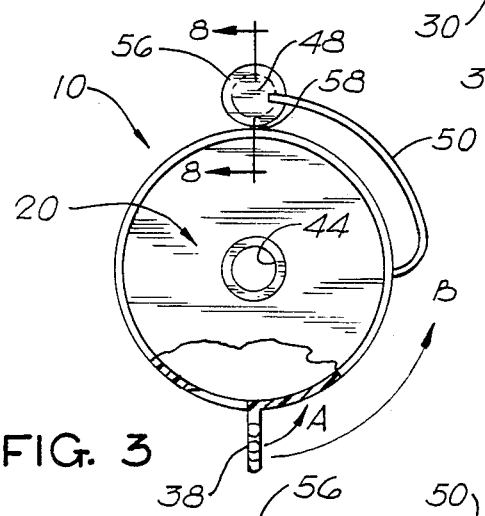
FIG. 3 is a plan view, partially cut away to show the vial and cap assembly of FIG. 1.

To remove cap 20 from vial 12, tab 38 may be pivoted inwardly as described above, then grasped and pulled around vial 12 in the direction of arrow B in FIG. 3. When this is done, the tear member 36 around the bottom of cap skirt 24 is effectively displaced, the cap-vial interlock is destroyed, and the cap is free to be lifted from vial 12.

Figure 2:
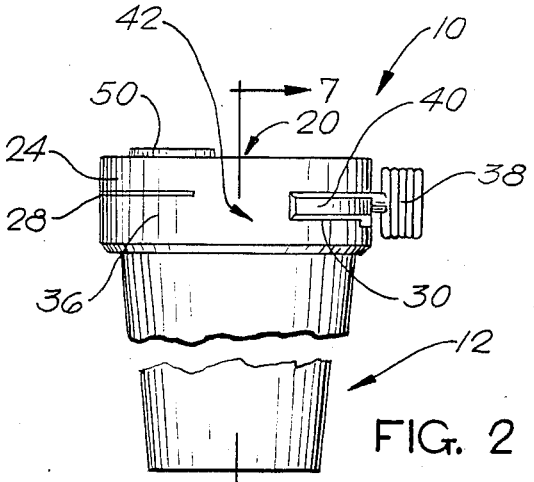
FIG. 2 is a fragmented elevation view of the vial and cap assembly of FIG. 1.

The improved construction of the present invention permits destruction of the cap-vial interlock, thereby freeing cap 10 from vial 12. However, because the line 28 terminates as shown in FIG. 2, the tear strip 36 is not totally removed. The non-weakened portion 42 retains the displaced tear member 36 as a unitary structure with the top of the cap 22. The section 42 of skirt 24 that junction line 28 does not circumscribe prohibits the complete removal of tear band 36. Since tear member 36 cannot be removed completely it is very obvious when the cap and vial assembly constituting the present invention has been tampered with. Also, the connection of the tear band 36 at point 42 on the cap permits the tearing of the line and the opening of the vials to be completed in one continuous motion.

The construction of the present invention, which permits filling of vial 12 after cap 20 has been mounted on the vial, which nevertheless precludes post-filling contamination or tampering, comprises a fill hole 44 formed in the top portion 22 of cap 20. The fill hole 44 is quite small in relation to the surface area of cap top 22 but is made large enough to receive a conventional blunt fill needle as conventionally used in the filling of back-fill syringes and vials. Such a fill needle 46 is shown in phantom lines in FIG. 5. Fill hole 44 affords ready access to the interior of vial 12 so that the vial can be filled with cap 20 mounted on the vial. A fill hole diameter approximating $\frac{3}{8}$ inch is preferred.

The placement of fill hole 44 is irrelevant for most applications. However, it may be crucial if the assembly is to be filled by machine as some known filling machines require the filling hole 44 to be located at the center of cap 20. Many prior art vial and cap assemblies do not take this requirement into consideration and so must be filled manually. Accordingly, one preferred embodiment of the present invention has the filling hole 44 located at the center of cap 20.

Figure 8:
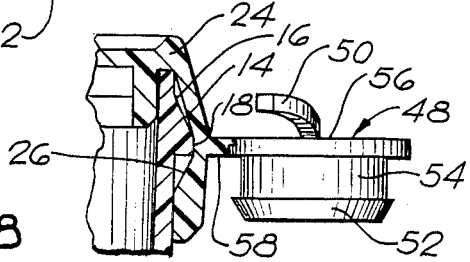
FIG. 8 is a detail fragmentary sectional view taken generally along the line 8—8 in FIG. 3 illustrating the positioning of the stopper prior to its use.

Cap 20 further includes a small stopper 48 molded as a part of cap 20 and connected to the cap skirt 24 by an elongated integral flexible connector element 50. For example, connector element 50 may comprise a thin strap approximately 0.04 inches square. Stopper 48 includes a tapered lower portion 52, a reduced diameter peripheral portion 54, and an enlarged upper disc portion 56. Stopper 48 has a configuration that allows insertion into the fill hole 44 but that effectively precludes manual removal from the fill hole 44 after insertion, as described below. A very small fragile bridge connection 58 between stopper top 56 and skirt 24 may be formed in molding cap 20; see FIGS. 3, 4 and 8.

Figure 5:
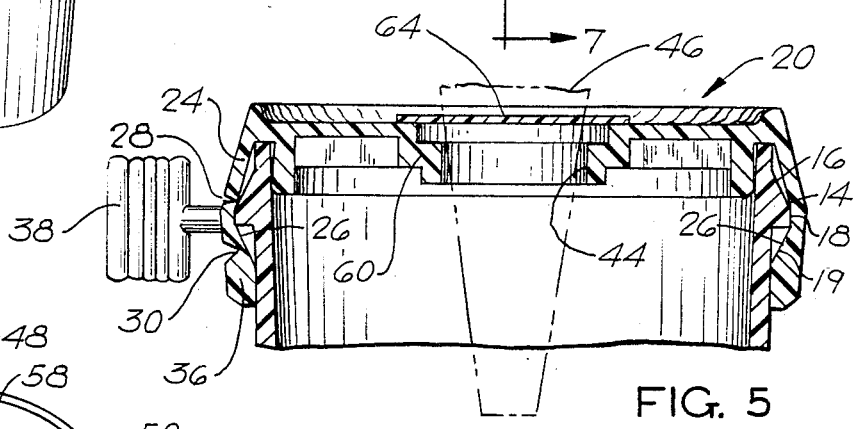
FIG. 5 is a detail sectional view, on an enlarged scale, taken approximately along the line 5—5 in FIG. 1, but with the stopper not yet positioned in the top fill hole.
Figure 6:
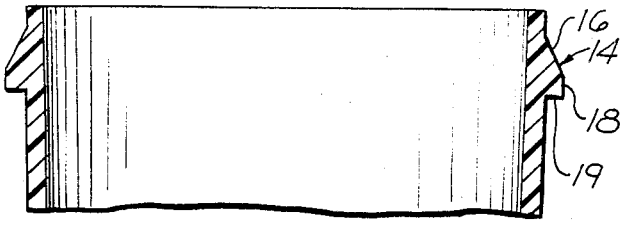
FIG. 6 is a sectional view illustrating the vial of FIG. 5 without the installed cap assembly for clarification.
Figure 4:
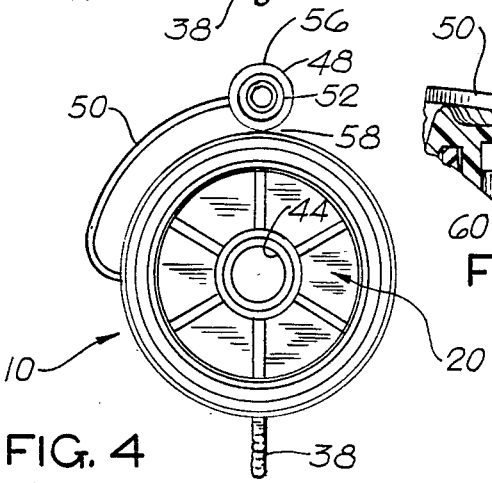
FIG. 4 is a bottom view of the cap of FIG. 1.

The manner in which vial 12 is filled with a predetermined dosage of a pharmaceutical preparation is generally illustrated in FIG. 5, assuming cap 20 has previously been mounted on vial 12. A fill needle 46 is inserted in the top 22 of cap 20, through fill hole 44. The fill needle 46 is usually mounted on a fill tube (not shown), which may be connected to a dispensing machine. The desired dose of the pharmaceutical is deposited in vial 12 in this manner, following which stopper 48 is inserted in fill hole 44 to close and seal the vial.

Figure 7:
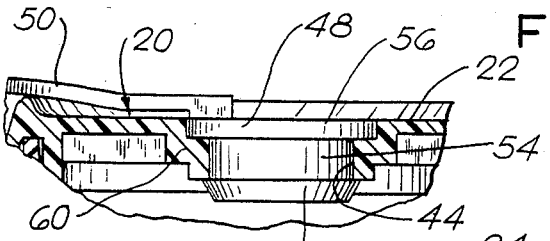
FIG. 7 is a detail fragmentary, sectional view illustrating use of a stopper that is part of the cap taken generally along the line 7—7 in FIG. 2.

FIG. 7 shows stopper 48 mounted in place in fill hole 44 after filling of the vial. The tapered lower portion 52 of the stopper has been forced down through fill hole 44, the axial length of which is extended by a stepped skirt 60 formed integrally with cap top 22. The top of the tapered portion 52 of stopper 48 is larger than the fill hole 44 and the peripheral, reduced diameter portion 54 provides an interference fit with the fill hole 44. The tapered lower portion 48 is larger than the fill hole 44 at its maximum diameter which extends below the fill hole 44 to lock the stopper in the hole and to prevent nondestructive removal. With stopper 48 in place, fill hole 44 is closed and sealed both by the lower tapered portion 52 of the stopper and by the top cover portion 56 of the stopper. To assure an effective seal, the reduced diameter peripheral portion 54 in stopper 48 should be essentially equal in height to the thickness of the cap top 22 as shown so that a tight seal is obtained.

As will be apparent from FIG. 7, the configuration of stopper 48 effectively precludes manual removal of the stopper from fill hole 44. The tamper-resistant characteristics of stopper 48 are provided by a countersunk portion forming an annular ridge molded into cap top 22 concentric with and around the top of fill hole 44 for seating of the enlarged upper portion 56 of stopper 48. The countersunk annual ridge is equal to both the depth and the diameter of the enlarged upper portion 56 of stopper 48. This allows stopper 48 to both lie flush with and abut peripherally the cap top 22 and the countersunk annular ridge, respectively.

To prevent contamination of the interior of vial 12 prior to filling, it may be desirable to close fill hole 44 with a temporary closure member 64, as shown in FIG. 5. The temporary closure member 64 may, in its simplest form, comprise a thin circular seal such as a strip of film coated with an appropriate pressure sensitive adhesive on the surface that seals the fill hole 44 of cap 20. Preferably, the temporary closure member 64 may be formed as a thin molded plastic element integral with cap 20, that can be readily broken by even the blunt fill needle 46. If an adhesively attached temporary closure member 64 is used, it is preferably removed before filling.

The vial and cap combination 10 shown in FIGS. 1 and 2 and described above permits assembly of the complete device at the point of manufacture. Thus, assembly 10 can be shipped to the hospital or other pharmacy with cap 20 already mounted on vial 12. Of course, the assembly can be sterilized at the factory and, particularly with fill hole 44 covered by a temporary closure member 64, can be readily maintained in sterile condition until filled. Thus, there is little or no opportunity for contamination prior to filling of the vial.

Once vial 12 has been filled with the desired pharmaceutical dosage, stopper 48 is immediately mounted in fill hole 44, closing and sealing the top of the vial. Stopper 48 effectively precludes casual contamination after filling; the filled vial can be stored for any desired length of time and is fully protected against contamination until actually used. Furthermore, after filling and insertion of stopper 48, tampering with the contents of the vial is prevented. Stopper 48, once mounted in place, resists manual removal so that there is no opportunity for adding anything to the contents of the vial or for removing any part of the vial contents, short of removal of cap 20.

At the time a pharmaceutical dosage in vial 12 is to be administered to a patient, either a nurse or a patient opens the vial simply by pulling on tab 38 to release the tear band 36. With the tear band effectively displaced cap 20 simply lifts off of vial 12 and oral administration proceeds unimpeded. There is little or no danger of re-use, since the pulled away tear band 36 remains, making it obvious that the vial assembly has been used and should not be employed again.

It should be understood that various modifications can be made to the preferred embodiments disclosed herein without the loss of its attendant advantages. Thus, other examples applying the principles described herein are intended to fall within the scope of the invention provided the features stated in any of the following claims or the equivalent of such be employed.

I claim:

1. In a tamper-resistant pharmaceutical vial and cap assembly comprising an open-top vial for dispensation of a predetermined dosage of a pharmaceutical preparation and a molded cap of resilient material mounted on and covering the top of the vial, the cap having a flat circular portion covering the top of the vial and an integral skirt depending from the flat circular portion and encompassing the upper portion of the vial, the inner surface of the skirt and the outer surface of the upper portion of the vial comprising complementary mating interlock elements precluding manual removal of the cap from the vial, the cap further comprising a tear member defined by at least one weakened junction line such that removal of the tear member from the cap permits ready removal of the cap from the vial; wherein the improvement comprises:

means on the cap assembly for readily communicating that a said tear member on the assembly was previously disengaged from said cap along said weakened junction line, thereby indicating that the vial was previously opened or tampered with, said means for communicating previous tear member disengagement comprising partial circumferential circumscription of said weakened, tear member defining junction line around the cap skirt for an extent thereof sufficiently less than the entire circumference of the cap skirt, such that the tear member remains integrally attached to the cap skirt after separation of the tear member from the cap skirt to the fullest extent permitted by the weakened junction line;

a fill hole located in the flat circular portion of the cap affording access to the interior of the vial for filling thereof with the cap mounted on the vial;

a stopper insertable in the fill hole to close and seal the fill hole after filling of the vial, said fill hole being provided with an annular ridge extending radially outwardly from an uppermost perimeter of the fill hole, said ridge defining an annular flat area recessed below the flat circular portion of the cap and concentrically adjacent to the uppermost perimeter of said fill hole, whereby said fill hole is countersunk in said cap, said stopper having a widened-diameter annular top portion for seating in said annular ridge such that access to the stopper is restricted when the stopper is inserted in the counter-sunk fill hole and;

a starter tab at the beginning of said tear member for initiating disengagement of said tear member and grasping thereof preliminary to full removal of the tear member from the cap skirt, said starter tab comprising a flat, vertically aligned projection located at the beginning terminus of said tear member and projecting perpendicularly outwardly therefrom, said projection having a front and rear surface for grasping of said projection between a thumb and forefinger and whereby pressure of one finger against a surface of the tab such that the tab is forced flat against the cap in the direction of said tear member causes said weakened junction lines to break at a point behind or at the base of said tab approximately where said tab joins said tear member.

2. The improved vial and cap assembly of claim 1 wherein said partially circumferential weakened junction line circumscribes approximately three-fourths of said cap.

3. An improved vial and cap assembly according to claim 1 in which the stopper is molded integrally with the cap and is connected to the cap by an integral molded connector element.

4. An improved vial and cap assembly according to claim 1 and further comprising temporary closure means for closing the fill hole prior to filling of the vial.

5. An improved vial and cap assembly according to claim 4 in which the temporary closure means comprises a thin, puncturable membrane molded integrally with the cap.

6. An improved vial and cap assembly according to claim 4 in which the temporary closure means comprises a thin membrane adhesively mounted on the outer top surface of the cap.

7. An improved vial and cap assembly according to claim 1 wherein the annular ridge is identical in diameter to the annular top portion of the stopper.

8. An improved vial and cap assembly according to claim 1 wherein said annular ridge is substantially identical in height to the height of the top portion of the stopper.

* * * * *